US007809314B2

(12) United States Patent
Sawai

(10) Patent No.: US 7,809,314 B2
(45) Date of Patent: Oct. 5, 2010

(54) IMAGE FORMING APPARATUS CAPABLE OF PREVENTING GENERATION OF RESIDUAL IMAGES AND TRANSFER FAILURE

(75) Inventor: Yuuji Sawai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 945 days.

(21) Appl. No.: 11/608,599

(22) Filed: Dec. 8, 2006

(65) Prior Publication Data

US 2007/0134029 A1 Jun. 14, 2007

(30) Foreign Application Priority Data

Dec. 8, 2005 (JP) ..... 2005-354253
Oct. 27, 2006 (JP) ..... 2006-292592

(51) Int. Cl.
*G03G 15/00* (2006.01)

(52) U.S. Cl. ..... 399/302

(58) Field of Classification Search ..... 399/302, 399/121

See application file for complete search history.

(56) References Cited

U.S. PATENT DOCUMENTS 6,067,435 A * 5/2000 Soga et al. ..... 399/302
6,516,179 B1 2/2003 Sawai et al.
6,611,672 B2 8/2003 Aoki et al.
6,618,565 B2 9/2003 Tamiya et al.
6,697,595 B2 2/2004 Kawagoe et al.
6,741,821 B2 5/2004 Sugino et al.
6,768,892 B2 7/2004 Sawai
6,785,500 B2 8/2004 Takahashi et al.
6,813,471 B2 11/2004 Sawai et al.
6,823,149 B2 11/2004 Yoshikawa et al.
6,829,450 B2 12/2004 Tamiya et al.
6,885,842 B2 4/2005 Sawai
6,901,234 B2 5/2005 Ogiyama et al.
7,003,238 B2 2/2006 Yoshida et al.
6,983,121 B2 11/2006 Sawai
2002/0034405 A1 3/2002 Kayahara et al.
2003/0118359 A1 6/2003 Ogiyama et al.

(Continued)

FOREIGN PATENT DOCUMENTS

EP 0 840 175 A2 6/1998

(Continued)

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

An image forming apparatus includes an image bearing member, supporting rollers, a belt-like-shaped medium, a primary transfer member, secondary transfer rollers, and a grounded conductive roller. The image bearing member forms a toner image at a predetermined process speed. The belt-shaped medium has a charge voltage. The primary transfer member sequentially transfers the toner image onto the belt-like-shaped medium and the secondary transfer member transfers the toner image onto a recording sheet. The conductive roller is arranged in contact with the belt-shaped medium for a predetermined wrapping length. A relationship $Tb<X/Vb$ is satisfied, where Tb is a decay time period that the charge voltage of the belt-shaped medium decays from approximately 200 volts to 200/e volts, where e is a base of natural logarithm, X is the predetermined wrapping length of the belt-shaped medium against the conductive roller, and Vb is the predetermined process speed.

8 Claims, 10 Drawing Sheets

U.S. PATENT DOCUMENTS

| | | | | |
|---|---|---|---|---|
| 2004/0062576 | A1* | 4/2004 | Saito et al. | 399/302 |
| 2004/0109709 | A1 | 6/2004 | Ishibashi et al. | |
| 2005/0013636 | A1 | 1/2005 | Sawai et al. | |
| 2005/0169668 | A1 | 8/2005 | Koichi et al. | |
| 2005/0180776 | A1* | 8/2005 | Shin | 399/127 |
| 2005/0286930 | A1 | 12/2005 | Sawai et al. | |
| 2006/0056884 | A1 | 3/2006 | Sawai et al. | |
| 2006/0127116 | A1 | 6/2006 | Ogiyama et al. | |

FOREIGN PATENT DOCUMENTS

| | | |
|---|---|---|
| EP | 1 424 608 A2 | 6/2004 |
| JP | 2002-174941 | 6/2002 |
| JP | 2003-177610 | 6/2003 |

* cited by examiner

FIG. 6A

FIG. 6

| FIG. 6A | FIG. 6B |
|---|---|

| | ROLLER DIAMETER | WINDING ANGLE | X WINDING AMOUNT | Vb SPEED | X/Vb WINDING TIME |
|---|---|---|---|---|---|
| | mm | ANGLE | mm | mm/sec | sec |
| COMPARATIVE EXAMPLE 1 | 26 | 175 | 39.7 | 155 | 0.26 |
| COMPARATIVE EXAMPLE 2 | 26 | 175 | 39.7 | 155 | 0.26 |
| COMPARATIVE EXAMPLE 3 | 26 | 175 | 39.7 | 155 | 0.26 |
| COMPARATIVE EXAMPLE 4 | 26 | 175 | 39.7 | 155 | 0.26 |
| COMPARATIVE EXAMPLE 5 | 26 | 175 | 39.7 | 255 | 0.16 |
| EXEMPLARY EMBODIMENT 1 | 26 | 175 | 39.7 | 155 | 0.26 |
| EXEMPLARY EMBODIMENT 2 | 38 | 175 | 58.0 | 255 | 0.23 |
| EXEMPLARY EMBODIMENT 3 | 26 | 175 | 39.7 | 155 | 0.26 |
| EXEMPLARY EMBODIMENT 4 | 26 | 175 | 39.7 | 155 | 0.26 |

FIG. 6B

| Tb TIME CONSTANT sec | SURFACE RESISTIVITY Ω | DEBRIS | RESIDUAL IMAGE | TRANSFER FAILURE | DISCHARGE |
|---|---|---|---|---|---|
| 1.10 | $5.0 \times 10^{10}$ | GOOD | GOOD | NOT GOOD | GOOD |
| 0.08 | $7.0 \times 10^{9}$ | OK | GOOD | GOOD | GOOD |
| 0.08 | $9.0 \times 10^{8}$ | NOT GOOD | GOOD | GOOD | GOOD |
| 0.20 | $7.0 \times 10^{12}$ | GOOD | GOOD | GOOD | NOT GOOD |
| 0.20 | $7.0 \times 10^{12}$ | GOOD | NOT GOOD | NOT GOOD | NOT GOOD |
| 0.20 | $4.0 \times 10^{10}$ | GOOD | GOOD | GOOD | GOOD |
| 0.20 | $3.0 \times 10^{12}$ | GOOD | GOOD | GOOD | GOOD |
| 0.08 | $6.0 \times 10^{11}$ | GOOD | GOOD | GOOD | GOOD |
| 0.20 | $3.0 \times 10^{12}$ | GOOD | GOOD | GOOD | GOOD |

IMAGE FORMING APPARATUS CAPABLE OF PREVENTING GENERATION OF RESIDUAL IMAGES AND TRANSFER FAILURE

CROSS REFERNCE TO RELATED APPLICATIONS

This patent specification is based on Japanese patent application, No. JP2005-354253 filed on Dec. 8, 2005 and No. JP2006-292592 filed on Oct. 27, 2006 in the Japan Patent Office, the entire contents of each of which are incorporated herein by reference.

BACKGROUND

1. Field of Invention

Exemplary aspects of the present invention relate to an image forming apparatus, and more particularly to an image forming apparatus capable of preventing generation of a residual image and a failure in an image transfer.

2. Discussion of the Background

In recent years, downsizing, a reduction in weight, and an enhancement of processing speed are increasingly desired in an image forming apparatus. Even if the processing speed is enhanced, there are an increasing number of cases where a belt-type medium is not provided with a dedicated discharging member. The attenuation of residual charge of the belt-type medium is performed when the belt-type medium comes into contact with a grounded conductive spanned roller during a rotary operation thereof. The diameter of the grounded conductive roller is configured to be relatively large so that the contact time becomes longer, and thereby, the discharging effect is enhanced. Furthermore, in order to accommodate the attenuation characteristics of the belt-type medium, imaging conditions including a correction of transfer voltage conditions, for example, are addressed.

Japanese Patent Laid-Open Application Publication No. 2003-177610 proposes that the attenuation time constant of the potential of an intermediate transfer belt is configured to be between 0.01 seconds and 1000 seconds.

Though Japanese Patent Laid-Open Application Publication No. 2003-177610 proposes that the time constant is less than or equal to 600 seconds, preferably, less than or equal to 100 seconds, the attenuation speed may be relatively slow for the belt-type medium when the time constant is less than or equal to 600 seconds. Consequently, problems such as a residual image may be generated due to the residual potential. Furthermore, the attenuation of the charge of the charged belt is performed when coming into contact with a conductive portion. Therefore, when the charged belt is in contact with a metal roller or the like for a short period of time, a substantial attenuation may not be performed. In other words, when the time constant of the belt-type medium is 600 seconds, or even 100 seconds, the substantial discharging time may not be obtained. Consequently, a discharging mechanism is essentially required for the belt. In a case where the discharging mechanism is not provided, a correction of the transfer electric current may be necessary to accommodate the belt charge which varies depending on the use conditions.

Furthermore, in order to accommodate demands for downsizing, a reduction in weight, and an enhancement of processing speed, the diameter of the conductive spanned roller is configured to be relatively large. However, when the diameter of the conductive spanned roller is relatively large, the weight and the belt perimeter will increase, accordingly. As a result, the unit will become larger in size, and the cost may increase accordingly.

When an image formation is continuously performed while the residual potential is accumulated on the belt-type medium, problems such as the residual image and an image failure may be generated. Because the residual potential of the belt-type medium is not constant, the correction of the imaging conditions, such as transfer conditions, is difficult to perform. Therefore, transfer failure can easily occur.

Normally, a primary transfer voltage is applied by an elastic roller or the like at a downstream end of a nip. The surface resistivity of the rear surface affects the quality of the transfer image. When the surface resistivity thereof is relatively low, the charge migrates in a plane direction, and the charge distribution at the transfer nip is widened. Consequently, the belt potential at the beginning portion of the primary transfer increases, thereby increasing the electric field at a void area and causing image debris to be easily generated.

On the other hand, when the surface resistivity of the rear surface is relatively high, the charge migration in the plane direction decreases, and the charge distribution is narrowed. Consequently, the electric field at the void area of the beginning portion of the primary transfer is reduced, thereby making it possible to prevent image debris. In other words, when the surface resistivity of the belt-like medium is in a range between $1\times10^{10}$ Ω and $5\times10^{12}$ Ω, the charge migration in the plane direction may be reduced, and the effectiveness of the prevention of the image debris may be enhanced. However, the attenuation of an area in the vicinity of the contact area is reduced due to the charge flow. As a result, the efficiency of the belt discharge by the conductive roller is decreased. Furthermore, when the surface resistivity of the rear surface is relatively high, the discharge time, in which the conductive roller comes into contact with the belt-type medium, will become an issue.

When the surface resistivity of the rear surface of the belt-type medium is less than or equal to $1\times10^{10}$ Ω, particularly less than or equal to $1\times10^{9}$ Ω, more charge flows in the plane direction so that an effective discharge may be performed. Accordingly, the discharge may be effectively performed on the roller of a small diameter which causes a short contact time. On the other hand, when the surface resistivity of the rear surface is more than or equal to $5\times10^{12}$ Ω, discharge may occur after the primary transfer, thereby causing the image failure to easily occur.

The amount of the charge of the rear and front surfaces of the belt immediately after the primary transfer is not the same. The charge from the nip is supplied to the place from the nip end to the separating position to perform discharge. However, depending on the surface resistivity, the amount of the charge supply may vary. When the surface resistivity is more than or equal to $5\times10^{12}$ Ωthe amount of the charge supplied from the nip is less so that discharge is difficult to perform. Thus, the electric field around the belt is unstable and may cause nearby devices to discharge.

SUMMARY OF THE INVENTION

In one example, an image forming apparatus includes one or more image bearing members, a plurality of supporting rollers, a belt-shaped medium, one or more primary transfer members, secondary transfer rollers, and at least one conductive roller. The one or more image bearing members are configured to form one or more toner images thereon at a predetermined process speed. The belt-shaped medium are configured to be charged with a charge voltage, rotatable, extended between the plurality of supporting rollers, and held in contact with the one or more image bearing members. The one or more primary transfer members correspond to the one or more image bearing members on a one-to-one basis, and are configured to sequentially transfer the one or more toner images formed on the one or more image bearing members onto the belt-shaped medium. The secondary transfer member is configured to transfer the toner image carried on the belt-shaped medium onto a recording sheet. The at least one conductive roller is connected to a ground and is arranged upstream from the primary transfer member and downstream from the secondary transfer member in a rotation direction of the belt-shaped medium, in contact with the belt-shaped medium by a predetermined wrapping length. In this image forming apparatus, a relationship $Tb<X/Vb$ is satisfied, where Tb is a decay time period, expressed in units of seconds, that the charge voltage of the belt-shaped medium decays from approximately 200 volts to 200/e volts, where e is a base of a natural logarithm, X is the predetermined wrapping length, expressed in units of millimeters, of the belt-shaped medium against the at least one conductive roller, and Vb is the predetermined process speed, expressed in units of millimeters per second.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein:

FIG. 6 includes FIGS. 6A and 6B which contain a table showing exemplary embodiments and comparative examples;

DETAILED DESCRIPTION OF EXEMPLARY EMBODIMENTS

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Figure 1:
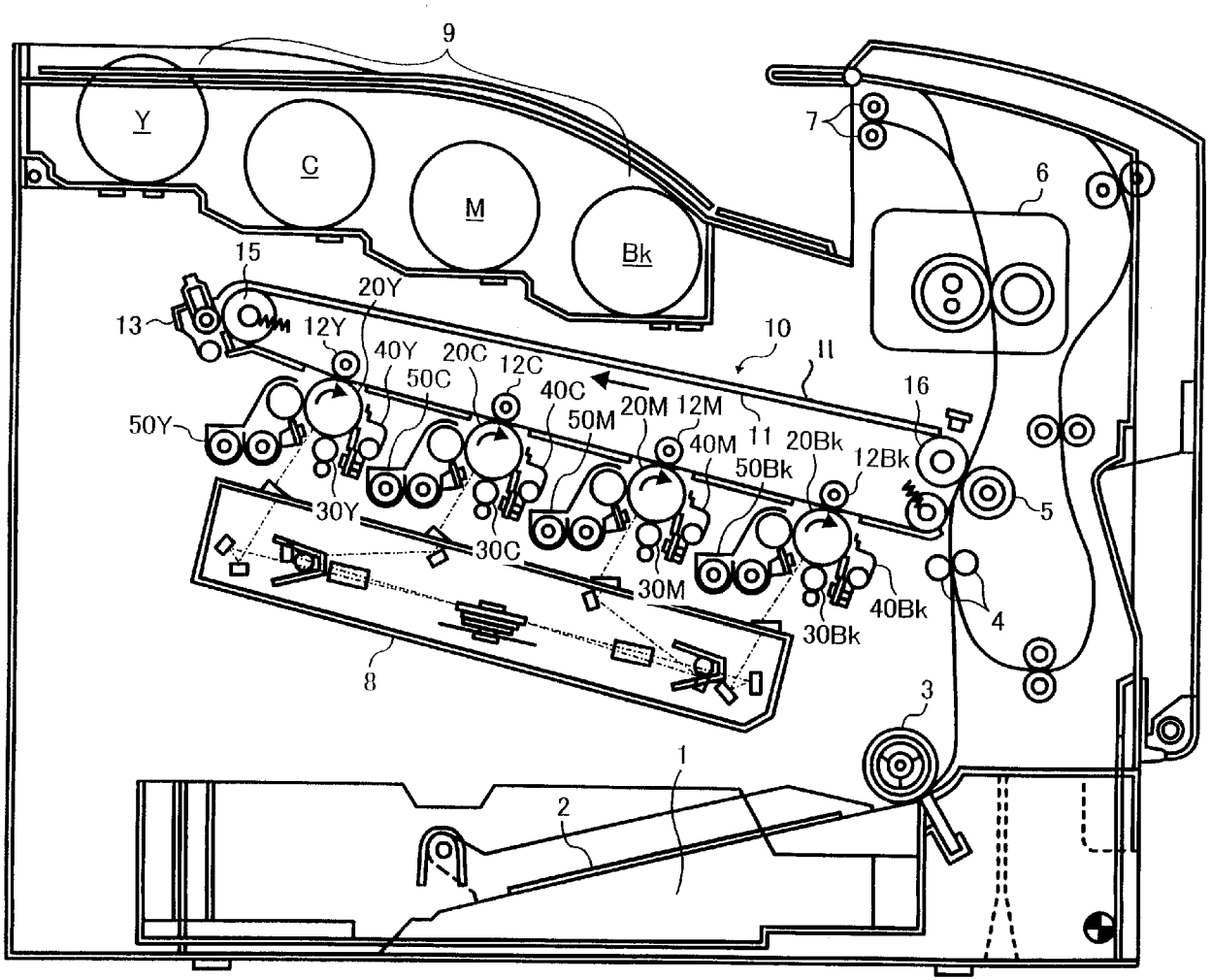
FIG. 1 is a schematic diagram illustrating an example of a color image forming apparatus to which an exemplary embodiment of the present invention may be applied.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity of drawings and descriptions, the same reference numerals are given to materials and constituent parts having the same functions, and descriptions thereof will be omitted unless otherwise stated. Exemplary embodiments of the present invention are now explained below with reference to the accompanying drawings. Referring now to the drawings, wherein like reference numerals designate identical or corresponding parts throughout the several views, particularly to FIG. 1, an image forming apparatus (e.g., a color image forming apparatus), according to an exemplary embodiment of the present invention, is explained.

A description will be given of a color image forming apparatus according to one exemplary embodiment of the present invention. The color image forming apparatus includes a transfer belt unit 10 having an intermediate transfer belt 11 and four image stations which are linearly disposed. Photoreceptors 20Y, 20C, 20M, and 20BK are each provided to the corresponding image station. Each of charging apparatuses 30Y, 30C, 30M and 30BK, developing apparatuses 50Y, 50C, 50M and 50BK, and cleaning apparatuses 40Y, 40C, 40M and 40BK is provided surrounding corresponding photoreceptors. Toner bottles 9Y, 9C, 9M and 9BK are filled with toners of different colors of yellow (Y), cyan (C), magenta (M) and black (BK) from the left in FIG. 1, respectively. A predetermined amount of toner is supplied to the developing apparatuses 50Y, 50C, 50M and 50BK by a toner supply mechanism (not-shown).

A transfer sheet 2 is transported from a sheet feed cassette 1 by a sheet feed roller 3 according to print signals. The tip of the transfer sheet 2 is transported to registration rollers 4. The transported transfer sheet 2 is detected by a sensor so as to determine whether or not there is a paper jam. In accordance with image signals, the transfer sheet 2 is transported from the registration rollers 4 to the transfer position.

The photoreceptors 20Y, 20C, 20M and 20BK are uniformly charged by the respective charging apparatuses 30Y, 30C, 30M and 30BK in accordance with the print signals. Electrostatic latent images corresponding to the image signals are formed on the photoreceptors 20Y, 20C, 20M and 20BK by a writing apparatus 8. Each electrostatic latent image is developed by the respective developing apparatuses 50Y, 50C, 50M and 50BK so that toner images are formed.

A transfer voltage is applied on primary transfer rollers 12Y, 12C, 12M and 12BK so as to sequentially transfer the toner images formed on the photoreceptors 20Y, 20C, 20M and 20BK to the intermediate transfer belt 11 forming a superimposed toner image. Subsequently, the superimposed toner image formed on the intermediate transfer belt 11 is transported to a position between a secondary transfer roller 5 and a roller 16 disposed across from the secondary transfer roller 5. A transfer electric field is applied to the position between the secondary transfer roller 5 and a roller 16 so as to transfer the superimposed toner image on the transfer sheet 2, thereby forming the superimposed toner image on the sheet.

The transfer sheet 2, on which the superimposed toner image is formed, is transported to a fixing apparatus 6, and the toner image is fixed thereon. The transfer sheet 2 is ejected onto a catch tray by sheet eject rollers 7.

Residual toner remained on the image carriers is removed by each of respective cleaning apparatuses 40Y through 40BK. The charging apparatuses 30Y, 30C, 30M and 30BK, in which alternating current is superimposed by direct current, charge the image carriers in parallel with neutralization of charges so as to prepare for the subsequent image forming processing.

The residual toner remaining on the intermediate transfer belt 11 is removed by a belt cleaning apparatus 13. The charged intermediate transfer belt 11 naturally discharges and comes into contact with one of the opposing rollers 15 which is grounded and disposed across from the intermediate transfer belt cleaning apparatus 13 so as to perform attenuation to prepare for the subsequent image forming processing.

A secondary transfer is performed such that the transfer voltage is applied either on the secondary transfer roller 5 or on the roller 16. When the voltage is applied to the roller 16, the intermediate transfer belt 11 separates from the roller 16. Subsequently, the attenuation starts. While the intermediate transfer belt 11 is in a state where it is wound around the grounded opposing roller 15, the potential is effectively attenuated.

Figure 2:
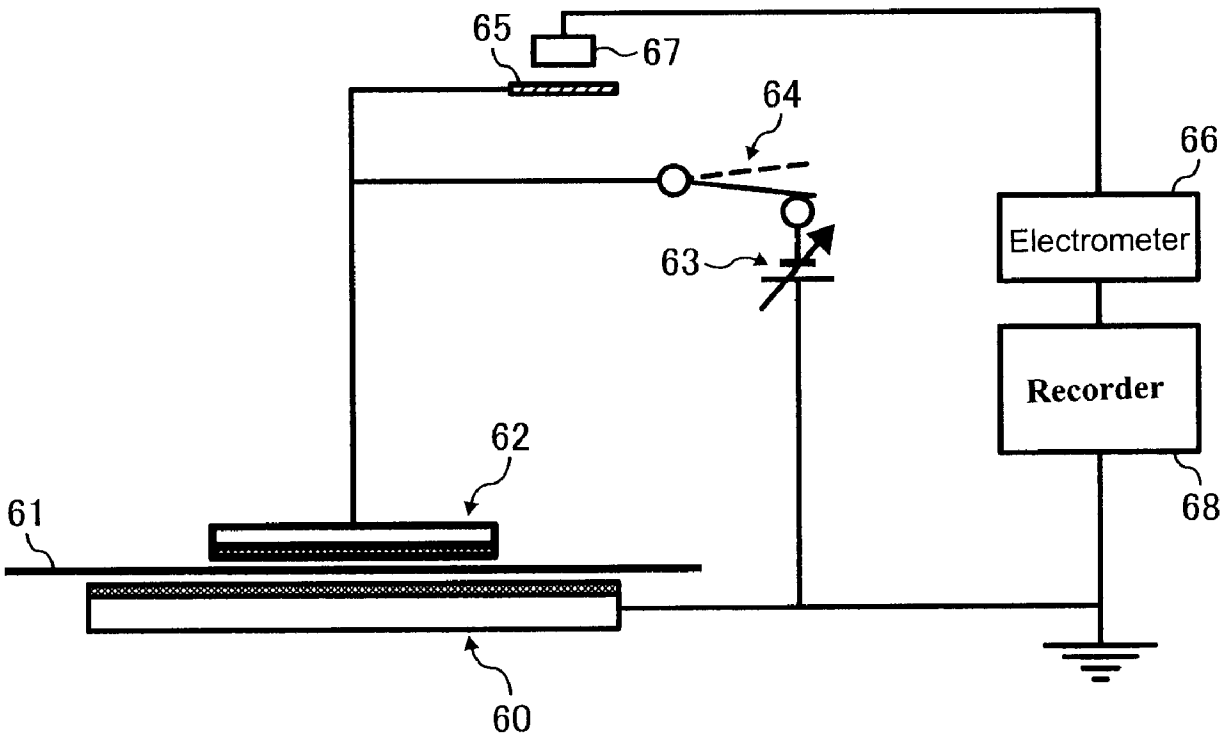
FIG. 2 is a diagram illustrating a measurement of a belt potential attenuation.

A belt potential attenuation measurement is performed such that, as shown in FIG. 2, a belt 61, which is a measuring object, is placed on an opposing electrode 60 formed of a metal plate on which a conductive rubber with a thickness of 1 mm is provided. A metal electrode 62 with a diameter ϕ of 10 mm, to which the conductive rubber is adhered, is placed on the belt 61, and a load of 2 kg is applied thereto. A constant voltage (200V) is applied to a place between the opposing electrode 60 and the metal electrode 62 for 10 seconds using a high-voltage power supply 63 such as the Trek Model 610 C, for example. Subsequently, attenuation characteristics are measured by turning off a switch 64 while the voltage is applied.

The metal electrode 62 with the conductive rubber is connected to a metal plate 65 for the potential measurement. The voltage corresponding to the belt potential is induced on the metal plate 65. The potential of the metal plate 65 is then measured by a surface electrometer 66 such as the Trek Model 344, for example, so that the attenuation characteristics are measured. The distance between the metal electrode 65 and a surface electrometer probe 67 is set to 1 mm. A surface potential output is output to a recorder 68 such as the Graphtec WR3101 Linearcorder, for example, so that a speed is measured based on an attenuation curve.

The attenuation characteristic measurement may be performed by inputting the data into a personal computer. In one exemplary embodiment, an experiment was performed by inputting the data into the personal computer, and the measurement was made.

In the experiment, the belt resistance measurement was performed using a Hiresta-UP MCP-HT450URS, manufactured by MITSUBISHI CHEMICAL CORPORATION with a probe made of conductive rubber, having a weight of 2 kg. The measurement condition includes an application of 500V for 10 seconds. FIGS. 3A through 3D show the belt potential attenuation characteristics according to the measurement experiment.

The surface potential is input into the computer to make a chart. Based on the attenuation curve of the chart, the time constant is obtained. For the sake of convenience, 0.0001 seconds is set as an initial time.

Figure 3A:
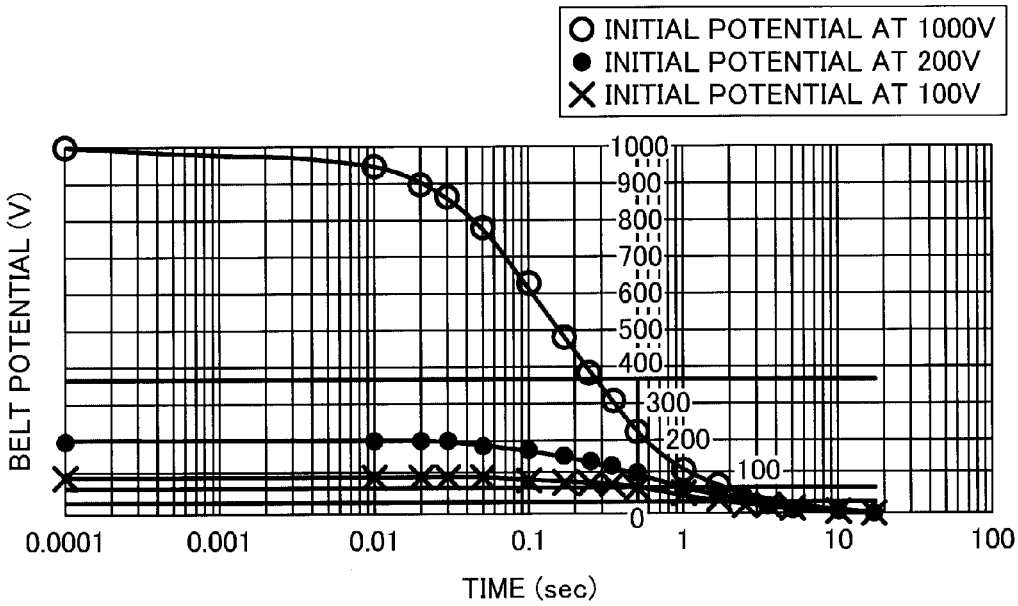
FIGS. 3A through 3D are diagrams illustrating attenuation characteristics of the belt potential.
Figure 3B:
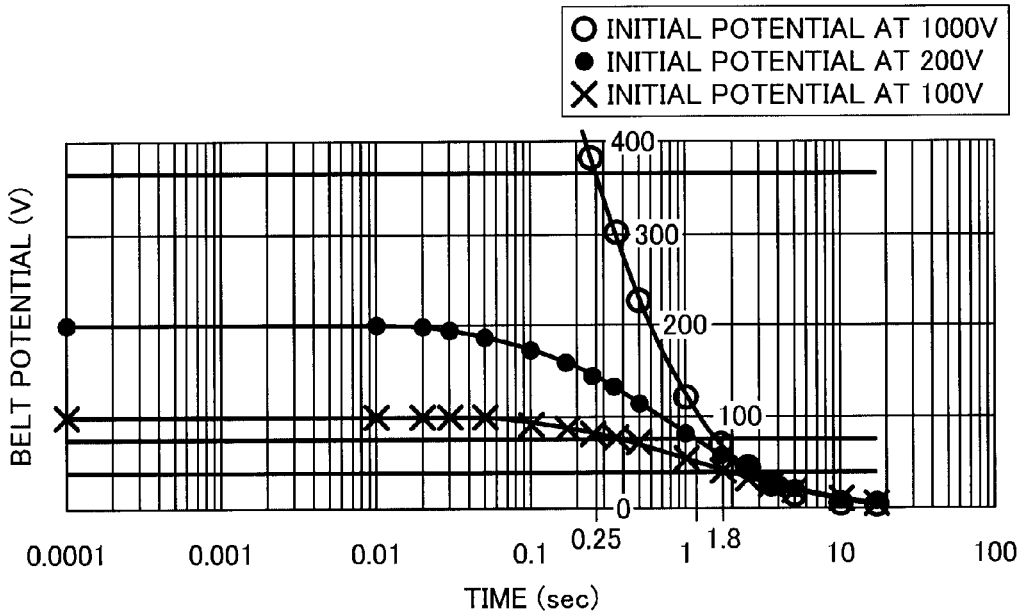
Figure 3C:
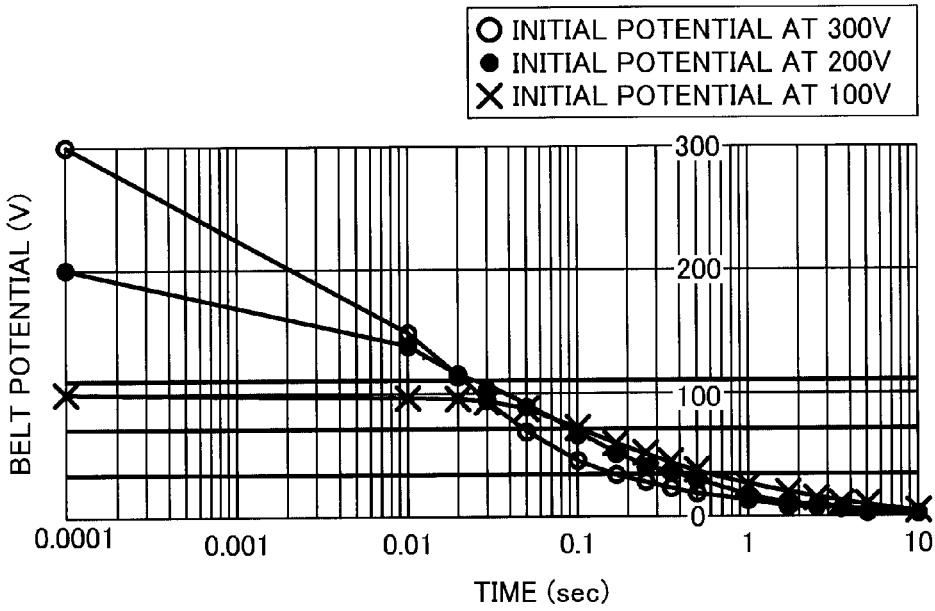
Figure 3D:
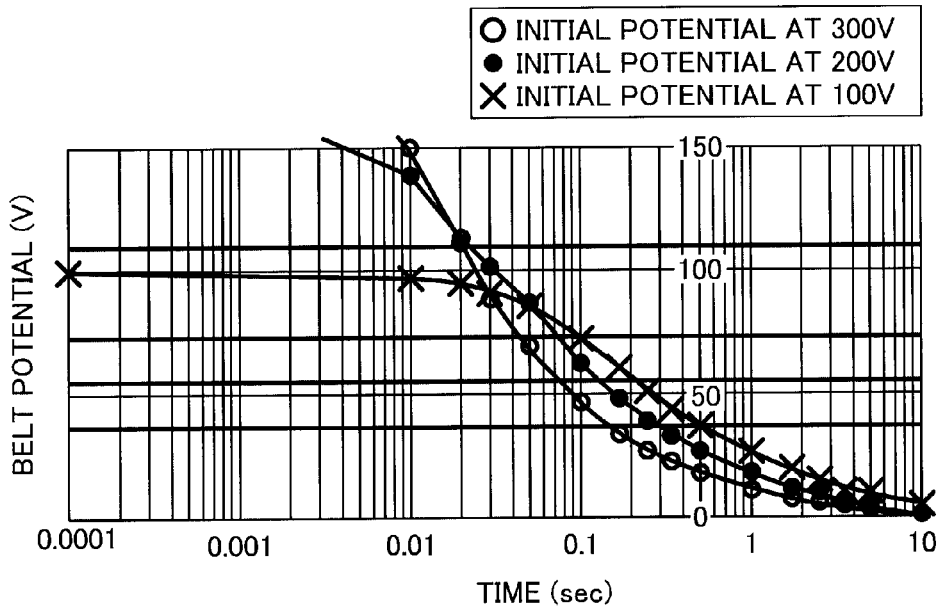

FIGS. 3A and 3B show the attenuation of the potential of a single-layer PVDF belt of the same data. Whereas a lateral axis or a Y axis of FIG. 3A is from 0V to 1000V, the lateral axis or the Y axis of FIG. 3B is from 0V to 400V so that the time constant may easily be identified. The time constant is an attenuation time in which the initial belt potential $V_0$ attenuates to the value obtained by $V_0/e$, where e is the base of natural logarithms 2.71828. When the voltage dependency of the time constant is obtained based on the attenuation curve shown in FIG. 3B, the time constant is 1.8 seconds at 100V, 1.1 seconds at 200V and 0.25 seconds at 1000V. The time constant varies from 1.8 seconds to 0.25 seconds when the belt potential is between 100V and 1000V. In a case where the difference of the time constant is applied to the belt potential of 1000V, the belt potential is 370V at the time constant of 0.25 seconds, and is 70V at the time constant of 1.8 seconds. A significant difference in the residual potential is observed. FIGS. 3C and 3D show the attenuation of the potential of a single-layer polyimide of the same data. Whereas the lateral axis or the Y axis of FIG. 3C is from 0V to 300V, the lateral axis or the Y axis of FIG. 3D is from 0V to 150V.

Figure 4:
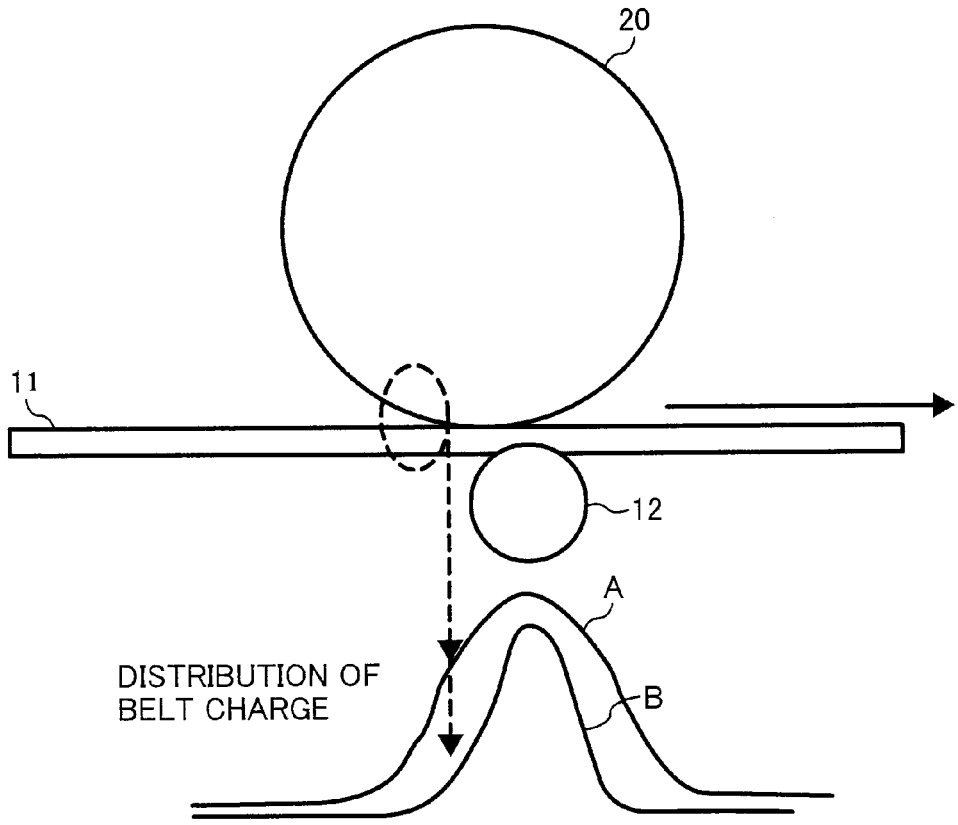
FIG. 4 is a schematic diagram illustrating a primary transfer portion.

The quality of the primary transfer debris may differ due to the surface resistivity. The reason is assumed as follows. FIG. 4 is a schematic diagram illustrating the primary transfer portion. The toner image formed on the photoreceptor 20 is transferred on the intermediate transfer belt 11 at a nip area indicated by a dotted circle between the photoreceptor 20 and the primary transfer roller 12. However, if the electric field of a void area before the nip area is relatively high, the toner on the photoreceptor 20 migrates in the void area causing the toner to transfer onto the belt. This is so-called void transfer. The toner migrated and transferred on the belt diffuses and becomes the transfer debris.

The primary transfer electric field is directly applied to the exit point of the transfer nip by the primary transfer roller 12 formed of a conductive foam roller. The charge then flows to the photoreceptor 20 through the intermediate transfer belt 11. Depending on the belt surface resistivity, the distribution of the charge differs in a plane surface direction. When the surface resistivity is relatively low, the charge may easily flow in the plane surface direction shown by a solid arrow, thereby widening the distribution of the charge as indicated by a distribution A of FIG. 4. Consequently, the electric field at a beginning portion of the void area becomes high, and debris may easily be generated. On the other hand, when the surface resistivity is relatively high, the distribution of the electric field is narrowed as indicated by a distribution B of FIG. 4, the electric field at the beginning portion of the void area becomes low, thereby reducing the generation of the void transfer. Consequently, the transfer debris may not easily be generated.

Figure 5:
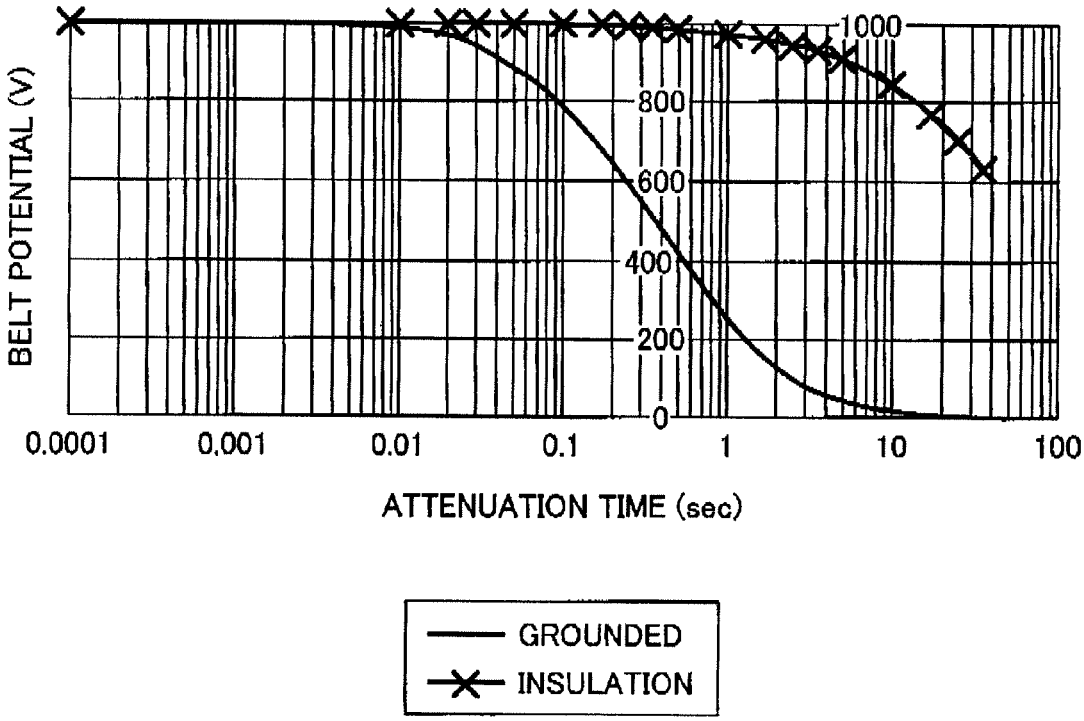
FIG. 5 is a diagram illustrating attenuation characteristics of an opposing electrode which is grounded and an insulating opposing plate.

FIG. 5 shows the attenuation characteristics of an opposing electrode which is grounded and an insulating opposing plate. It is understood that the attenuation time of the insulating opposing plate tends to be long relative to the attenuation of the grounded opposing electrode. The attenuation of the insulating opposing plate is caused mainly by natural discharge. Consequently, when the belt has a different time constant, the attenuation time may similarly be long. This may be because when the charged belt is at a position between the conductive spanned rollers, the attenuation hardly occurs. Instead, the attenuation may take place when the charged belt passes the conductive roller portion while being in contact with the conductive roller portion.

A description will be provided of comparative examples and the exemplary embodiments with reference to FIG. 6. The comparative example 1 is a case in which the belt time constant is greater than a belt winding time. In the apparatus shown in FIG. 1, a roller diameter of the opposing roller 15 is 26 mm, a belt winding angle is 175 degrees, and an imaging speed is 155 mm/second, while the belt winding time is 0.26 seconds, and the belt time constant is 1.1 seconds. In such a case, the time constant is greater than the belt winding time, thereby generating the residual potential. When 100 prints are continuously made, the transferability may be reduced causing an irregularity in a solid image area. Specifically, the irregularity may be significant in the two-color overlay image using colors of red, green and blue. As a result, an irregular image may be formed. The surface resistivity is within a range between $1\times10^{10}$ Ω and $5\times10^{12}$ Ω so that the generation of debris may be reduced, and a residual image and a discharge phenomenon may not occur.

In comparative examples 2 and 3, when compared with the comparative example 1, debris may be generated because the surface resistivity is relatively low. The lower the surface resistivity is, the more debris may be generated.

In a comparative example 4, when the surface resistivity is relatively high, the generation of the debris is improved. However, when the surface resistivity is higher by $7\times10^{12}$ Ω, the image irregularity may be generated due to the discharge phenomenon.

An imaging speed of an apparatus of a comparative example 5, which is a high-speed apparatus, is 255 mm/second relative to the comparative example 4. Because the belt winding time is less than the time constant, a transfer failure and residual image may be generated.

In a second exemplary embodiment, a roller diameter is 38 mm so as to increase the winding time from 0.16 to 0.23 seconds. Accordingly, a problem in which the belt winding time is relatively short due to a high-speed may be improved. In the exemplary embodiments and comparative examples, evaluations were performed using a tandem-type image forming apparatus without a discharging mechanism of an intermediate transfer belt.

Figure 7:
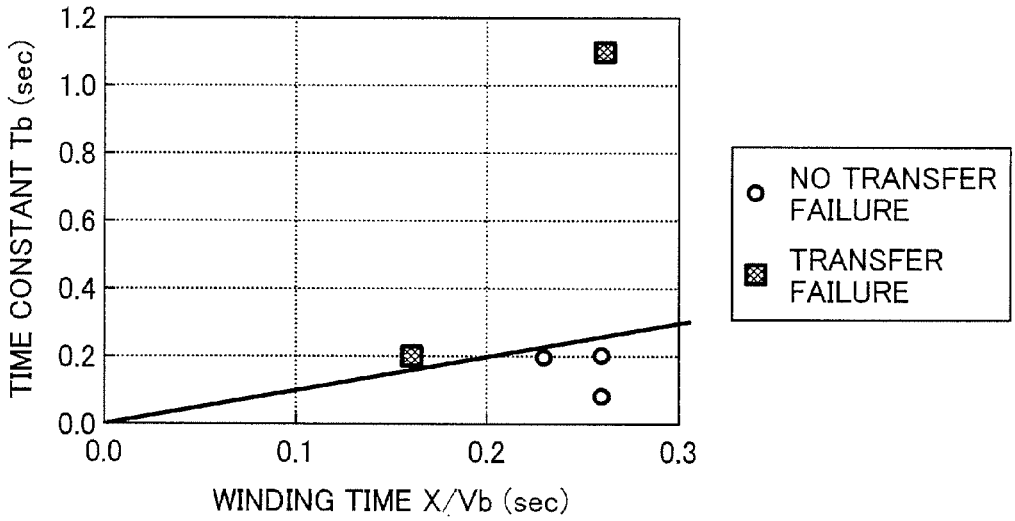
FIG. 7 is a diagram illustrating an occurrence of a transfer failure according to FIG. 6.
Figure 8:
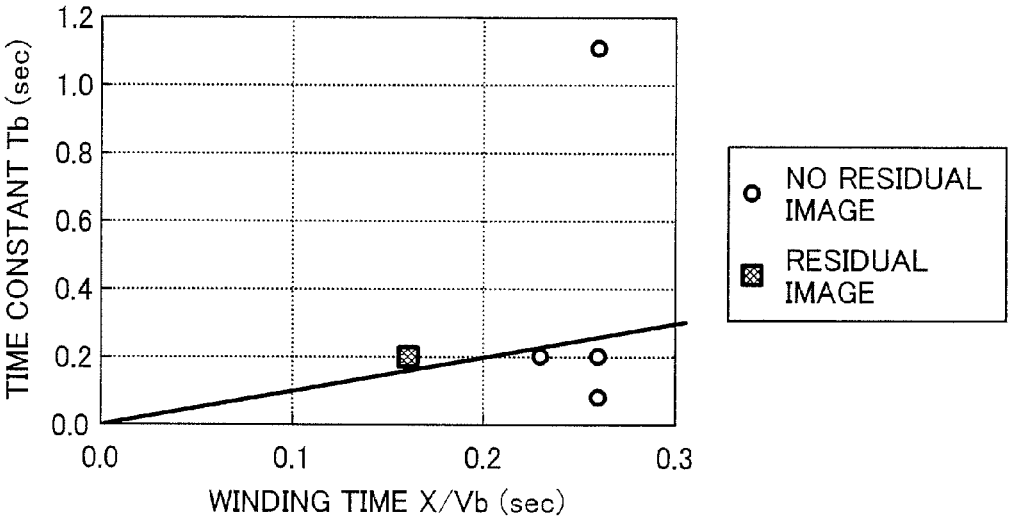
FIG. 8 is a diagram illustrating an occurrence of a residual image according to FIG. 6.

FIGS. 7 through 10 are charts showing the result of the exemplary embodiments and the comparative examples. FIG. 7 shows the occurrence of the transfer failure according to FIG. 6. FIG. 8 shows the occurrence of the residual image according to FIG. 6. According to FIG. 7 and FIG. 8, when X/Vb is greater than the time constant Tb (X/Vb >the time constant Tb), where X is a winding amount and Vb is a speed, an optimum result is achieved. That is, when the winding time X/Vb is greater than the time constant Tb in FIG. 7, no transfer failure occurs. When the winding time X/Vb is greater than the time constant Tb in FIG. 8, no residual image is generated. ○ in FIG. 7 indicates no transfer failure, whereas, ■ in FIG. 7 indicates that the transfer failure takes place. ○ in FIG. 8 indicates no residual image, whereas, ■ in FIG. 8 indicates that the residual image is generated.

Figure 9:
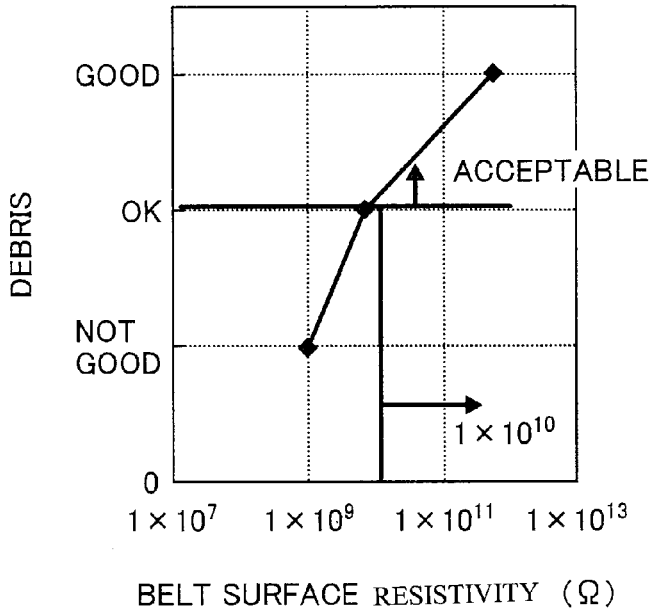
FIG. 9 is a diagram illustrating a relationship between a belt surface resistivity and debris.
Figure 10:
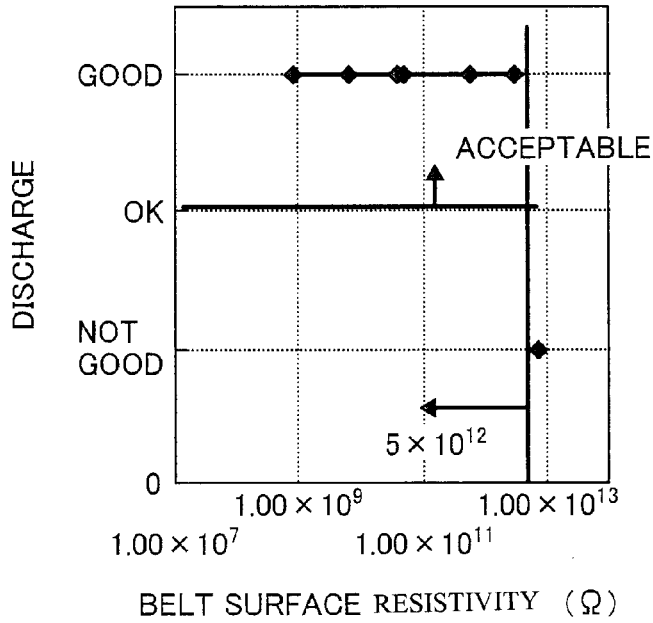
FIG. 10 is a diagram illustrating the relationship between the belt surface resistivity and discharge.

FIG. 9 shows the relationship between the belt surface resistivity and the debris according to the comparative examples 2 and 3, and another exemplary embodiment shown in FIG. 6. FIG. 10 shows the relationship between the belt surface resistivity and discharge according to FIG. 6. According to FIG. 9 and FIG. 10, when the belt surface resistivity is suppressed within a range between $1\times10^{10}$ Ω to $5\times10^{12}$ Ω discharge may be suppressed.

In other words, when the time constant of the intermediate transfer belt is less than or equal to the winding time of the intermediate transfer belt around the conductive roller, the electricity on the belt may substantially be removed, thereby making it possible to prevent problems associated with images due to the residual potential. When the surface resistivity is in a range between $1\times10^{10}$ Ω and $5\times10^{12}$ Ω, the transfer debris and the discharge phenomenon may be suppressed, thereby making it possible to prevent problems associated with images due to the residual potential.

Furthermore, when the time constant of the intermediate transfer belt is less than the winding time of the intermediate transfer belt around the conductive roller, the electricity on the belt may substantially be removed without the discharge mechanism, thereby making it possible to prevent problems associated with an image caused by the residual potential. Accordingly, based on the time constant and the winding time, an appropriate roller diameter may be configured. Furthermore, downsizing and a weight reduction, which are desired for the tandem-type apparatus, may be achieved.

A metal roller having a relatively good cleanability and surface properties to the extent of the prevention of the intermediate transfer member from getting damaged is desired for a roller disposed across from the cleaning portion at which an urethane rubber blade and the like come into contact. According to the exemplary embodiments, in a case where a metal roller is used for the opposing roller disposed across from the cleaning portion, problems such as blooming due to the conductive rubber roller and fluctuation of the resistance may be prevented. Therefore, it may be possible to perform substantial discharge of the intermediate transfer body.

Exemplary embodiments of this invention may be conveniently implemented using a conventional general purpose digital computer programmed according to the teachings of the present specification. Appropriate software coding can readily be prepared by programmers based on the teachings of the present disclosure. Exemplary embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structures for performing the methodology illustrated in the drawings.

Further, any of the aforementioned methods may be embodied in the form of a program. The program may be stored on a computer readable media and adapted to perform any one of the aforementioned methods, when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Exemplary embodiments being thus described, it should be apparent after reading this patent specification that the same may be varied in many ways. Such variations are not to be regarded as a departure from the spirit and scope of the present invention, and all such modifications as would be apparent to one skilled in the art are intended to be included within the scope of the following claims.

What is claimed is:

1. An image forming apparatus, comprising:

one or more image bearing members configured to form one or more toner images thereon at a predetermined process speed;

a plurality of supporting rollers;

a belt-shaped medium configured to be charged with a charge voltage, rotatable, extended between the plurality of supporting rollers, and held in contact with the one or more image bearing members;

one or more primary transfer members corresponding to the one or more image bearing members on a one-to-one basis, and configured to sequentially transfer the one or more toner images formed on the one or more image bearing members onto the belt-shaped medium;

a secondary transfer member configured to transfer the one or more toner images carried on the belt-shaped medium onto a recording sheet;

at least one conductive roller connected to a ground and arranged upstream from the one or more primary transfer members and downstream from the secondary transfer member in a rotation direction of the belt-shaped medium, and in contact with the belt-shaped medium for a predetermined wrapping length, wherein a relationship $Tb<X/Vb$ is satisfied, where Tb is an attenuation time period, expressed in units of seconds, that the charge voltage of the belt-shaped medium decays from approximately 200 volts to 200/e volts, where e is a base of a natural logarithm, X is the predetermined wrapping length, expressed in units of millimeters, of the belt-shaped medium against the at least one conductive roller, and Vb is the predetermined process speed, expressed in units of millimeters per second.

2. The image forming apparatus of claim 1, wherein the belt-shaped medium has a surface resistivity in a range of from approximately $1\times10^{10}$ Ω to approximately $5\times10^{12}$ Ω.

3. The image forming apparatus of claim 1, wherein the at least one conductive roller is configured to serve as a discharging roller relative to the belt-shaped medium.

4. The image forming apparatus of claim 1, wherein the at least one conductive roller is configured to serve as a belt cleaning roller and a discharging roller relative to the belt-shaped medium.

5. An image forming apparatus, comprising:

one or more image bearing members configured to form one or more toner images thereon at a predetermined process speed;

a plurality of supporting rollers;

a belt-shaped medium configured to be charged with a charge voltage, rotatable, extended between the plurality of supporting rollers, and held in contact with the one or more image bearing members;

one or more primary transfer members corresponding to the one or more image bearing members on a one-to-one basis, and configured to sequentially transfer the one or more toner images formed on the one or more image bearing members onto the belt-shaped medium;

a secondary transfer member configured to transfer the one or more toner images carried on the belt-shaped medium onto a recording sheet;

conductive means for grounding the image forming apparatus arranged upstream from the one or more primary transfer members and downstream from the secondary transfer member in a rotation direction of the belt-shaped medium, and in contact with the belt-shaped medium for a predetermined wrapping length, wherein a relationship $Tb<X/Vb$ is satisfied, where Tb is an attenuation time period, expressed in units of seconds, that the charge voltage of the belt-shaped medium decays from approximately 200 volts to 200/e volts, where e is a base of a natural logarithm, X is the predetermined wrapping length, expressed in units of millimeters, of the belt-shaped medium against the conductive means, and Vb is the predetermined process speed, expressed in units of millimeters per second.

6. The image forming apparatus of claim 5, wherein the belt-shaped medium has a surface resistivity in a range of from approximately $1\times10^{10}$ Ω to approximately $5\times10^{12}$ Ω.

7. The image forming apparatus of claim 5, wherein the conductive means serves as a discharging roller relative to the belt-shaped medium.

8. The image forming apparatus of claim 5, wherein the conductive means serves as a belt cleaning roller and a discharging roller relative to the belt-shaped medium.

* * * * *